United States Patent [19]

Bergstrom et al.

[11] 4,235,667

[45] Nov. 25, 1980

[54] METHOD OF AND MEANS FOR ATTAINING UNIFORMITY IN PAPER WEBS PRODUCED ON A ROLL FORMER

[75] Inventors: Jan I. Bergstrom, Beloit, Wis.; Richard E. Hergert, Rockton, Ill.

[73] Assignee: Beloit Corporation, Beloit, Wis.

[21] Appl. No.: 28,227

[22] Filed: Apr. 9, 1979

[51] Int. Cl.[3] ..... D21F 1/00

[52] U.S. Cl. ..... 162/203; 162/209; 162/211; 162/301; 162/312; 162/351; 162/352

[58] Field of Search ..... 162/203, 209, 210, 301, 162/302, 313, 314, 351, 352, 355, 356

[56] References Cited

U.S. PATENT DOCUMENTS

| | | | |
|---|---|---|---|
| 2,900,023 | 8/1959 | Hornbostel | 162/352 |
| 3,489,644 | 1/1970 | Rhine | 162/352 |
| 3,565,757 | 2/1971 | Jordansson | 162/203 |
| 3,573,159 | 3/1971 | Sepall | 162/352 |
| 3,574,054 | 4/1971 | Taylor | 162/211 |
| 3,578,558 | 5/1971 | McCarrick et al. | 162/203 |
| 3,582,467 | 6/1971 | Gustafson et al. | 162/203 |
| 3,746,613 | 7/1973 | Vauhkonen | 162/203 |

OTHER PUBLICATIONS

Paper Trade Journal, Jan. 11, 1965, p. 37.

*Primary Examiner*—William F. Smith
*Attorney, Agent, or Firm*—Hill, Van Santen, Steadman, Chiara & Simpson

[57] ABSTRACT

By imposing pressure pulses on mobile fibers in suspension in paper making stock slurry in the primary drainage area of the forming zone of a roll former substantially uniform distribution of the fibers is effected in forming of the paper web. A device for effecting the pressure pulses is located adjacent to the primary drainage area and may comprise a pressure pulse producing element of selected shape to control the length of the pressure pulse for the particular character of paper making fiber stock slurry involved in the paper web being formed.

14 Claims, 3 Drawing Figures

METHOD OF AND MEANS FOR ATTAINING UNIFORMITY IN PAPER WEBS PRODUCED ON A ROLL FORMER

This invention relates to the method of and means for attaining uniformity in forming a paper web on a roll former, that is, paper web making apparatus wherein the inner of a pair of convergently related cotravelling forming belts wraps the perimeter of a forming roll at least in a primary drainage area.

It has been generally recognized that paper sheet produced on twin belt or wire formers is less uniform, that is, has a much higher tendency to appear more flocculated, than paper sheet formed on other types of paper web formers. On the other hand, roll formers do have advantages among which may be mentioned a higher first pass fiber and fines retention than on other types of twin wire formers. It has been theorized that perhaps certain stationary elements in the forming zone of paper web formers other than the roll former types of apparatus may result in pressure pulses in the forming zone to cause redistribution of fibers on a microscale while drainage is taking place. In roll formers, there has heretofore been an absence of pressure pulses during the drainage phase, hence the tendency of the finished paper web to appear more flocculated or blotchy when held up to the light, that is, put to the look-through test. By way of example, reference is made to U.S. Pat. No. 3,582,467 which discloses and describes in some detail a desirable two wire roll former of the general type with which the present invention is concerned. The jet of paper making fiber stock slurry issues from an inlet or slice device toward the convergence of twin forming wires onto a forming roll which as there shown is of the open type for suction into the roll through the inner forming wire as well as drainage through the outer forming wire. In other types of roll formers, the forming roll may be solid and drainage effected through the porous outer belt or wire. In any event, the problem of nonuniform fiber distribution has persisted.

An important object of the present invention is to overcome the problem of lack of uniformity in fiber distribution in paper making roll formers.

This invention, therefore, provides a method of attaining uniformity in forming a paper web on a roll former, comprising directing a jet of paper making fiber stock slurry into a primary drainage area of a forming zone defined between convergent inner and outer forming belts, wherein said inner belt wraps the perimeter of a rotary forming roll throughout a substantial circumferential area and at least the outer belt is porous for drainage therethrough and beyond the primary drainage area also wraps said forming roll with the paper web squeezed between the belts, effecting primary drainage in said primary drainage area, and imposing pressure pulses on mobile fibers in suspension in said stock slurry in said primary drainage area and thereby effecting substantially uniform distribution of said fibers before the fibers become locked in the paper web.

The invention also provides in a roll former paper web making apparatus convergently related cotravelling inner and outer forming belts defining therebetween a forming zone having a primary drainge area, said inner belt wrapping the perimeter of a rotary forming roll throughout a substantial circumferential area, at least the outer of said belts being porous for drainage therethrough and beyond said primary drainage area also wrapping said forming roll with the paper web squeezed between the belts, means for directing a jet of paper making fiber stock slurry into said primary drainage area for primary drainage at least through said outer belt, and means for imposing pressure pulses on mobile fibers in suspension in said stock slurry in said primary drainage area for thereby effecting substantially uniform distribution of said fibers before the fibers become locked in the paper web.

Other objects, features and advantages of the invention will be readily apparent from the following description of certain representative embodiments thereof, taken in conjunction with the accompanying drawing although variations and modifications may be effected without departing from the spirit and scope of the novel concepts embodied in the disclosure and in which.

Figure 1:
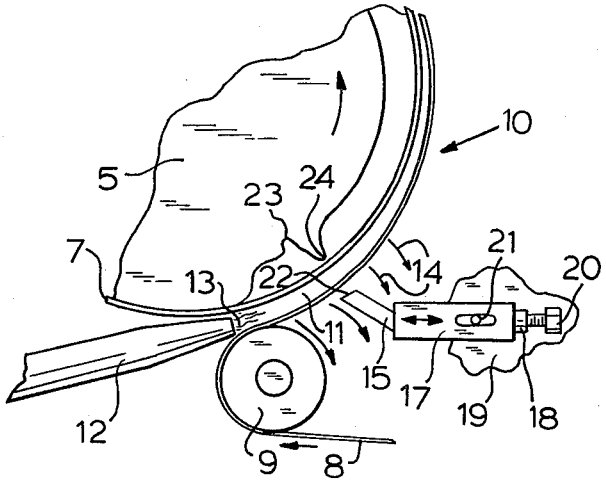
FIG. 1 is a schematic illustration of a roll former embodying the invention.

A roll former paper web making apparatus (FIG. 1) comprises a rotary forming roll 5 of suitable diameter and driven in any suitable manner at the desired web forming speed. An inner forming belt 7 wraps the perimeter of the forming roll 5 throughout a substantial circumferential area and travels at common speed with the rotation of the forming roll. An outer forming belt 8 which travels at the peripheral speed of the forming roll 5 and the linear speed of the inner forming belt 7 is guided by means such as a rotary guide roll 9 and other guide means (not shown) to converge toward the belt 7 to define between the belts a forming zone 10 having a primary drainage area 11. At least the outer forming belt 8 is porous for drainage of water therethrough. Beyond the primary drainage area 11, the outer belt 8 progressively converges toward the roll wrapping area of the inner belt 7 and also wraps the forming roll with the paper web squeezed between the belts. Means 12 often referred to as a slice directs a jet 13 of paper making fiber stock slurry into the primary drainage area 11 for primary drainage at least through the outer belt 8 as indicated by directional arrows 14. It will be understood that the fiber stock slurry will be delivered to the slice under suitable jet delivery pressure from an appropriate source such as a headbox, or the like (not shown) as is customary.

In order to attain uniformity in forming of the paper web, pressure pulses are imposed on the mobile fibers in suspension in the stock slurry in the primary drainage area 11 and before the fibers become locked in the paper web. Advantage is taken of the fact that although water is drained fairly rapidly from the stock slurry in the primary drainage area 11 of the forming zone 10, there is an interval in the primary drainage area 11 in which most if not all of the fibers are still at least minimally mobile in the suspension and thus capable of redistribution on a microscale while the drainage is taking place.

In one desirable form, means for imposing the pressure pulses on mobile fibers in suspension in the stock slurry in the primary drainage area 11 comprises one or more pulse creating elements 15, herein shown as one of such elements, which may comprise a bar structure extending transversely to and substantially throughout the width of the outer belt 8 and suitably spaced from the outer or drainage face of the belt 8 and aligned with an intermediate point along the length of the primary drainage area 11. The pulse generating member 15 is mounted in an adjustable stationary position relative to the primary forming zone area of the belt 8 in any suitable manner, as for example, by mounting the pulsing element bar on a supporting carrier structure 17 which may be mounted in a track 18 in a support 19 and reciprocatably adjustable as by means of an adjusting screw 20 with a pin and slot device 21 limiting the range of adjustment within practical limits.

Pressure pulses are generated by the stationary device 15 interrupting the free drainage flow from the primary drainage area 11 through the belt 8. That is, at its narrow edge 22, the bar 15 interrupts free flow of draining water between an upstream interval of free drainage and a downstream continuation of free drainage so that as indicated by the schematic drainage curve 23, there is a significant pulse 24 generated across the width of the primary drainage area 11 where freedom of drainage is momentarily interrupted in the travelling fiber stock suspension. The pulse 24 causes sufficient momentary agitation of the still mobile fibers in the suspension to redistribute individual fibers and effect substantially uniform distribution of the fibers before further drainage causes the fibers to become locked in the paper web. The magnitude of the pressure pulse effected by the device 15 can be controlled by the adjusted distance of the edge 22 from the porous forming belt 8. The shape, i.e., width of the edge 22 controls the length of the pressure pulse 24. Thereby, the fiber and fines loss are controlled and simultaneously improved formation of the paper web is attained.

Figure 2:
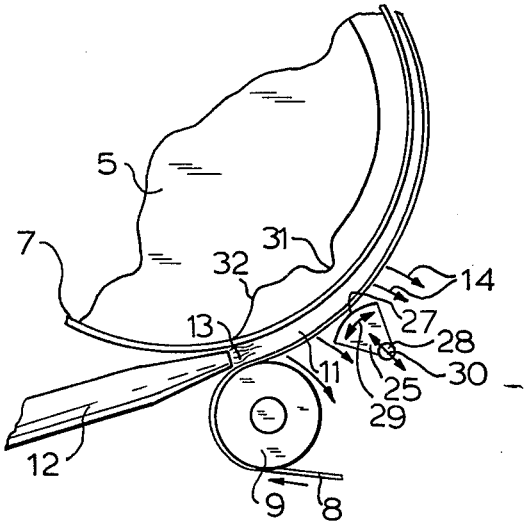
FIG. 2 is a schematic illustration of a roll former embodying a modification of the invention.

A modified pulsing device 25 (FIG. 2) comprises a bar which extends transversely relative to the outer forming belt 8 and substantially throughout the width of the belt and is located intermediate the length of the primary drainage area 11 in spaced adjacency to the outer face of the outer belt. In this instance, the pulsing device 25 has a segmental semicylindrical pulsing edge 27. Adjustability of the device 25 is both rockably about a pivot 28 for adjustment of the pulsing edge or surface 27 forwardly or backwardly as indicated by directional arrow 29. In addition, the device 25 is desirably mounted for adjustment in a reciprocal direction toward or away from the belt 8, as indicated by the directional arrow 30. As a result, a wide range of paper making stock characteristics can be accommodated efficiently by appropriately adjusting the device 25 to attain the pulsing results best designed to attain substantial uniformity with the particular paper making stock slurry being processed into paper web. In other words, the height of pulse 31 in the drainage curve 32 can be adjusted by positioning the pulsing device 25 in the direction of the double arrow 30 and the width as well as the circumferential position of the pulse 31 can be adjusted by adjusting the device 25 according to the doubleheaded arrow 29, to attain optimum results.

Figure 3:
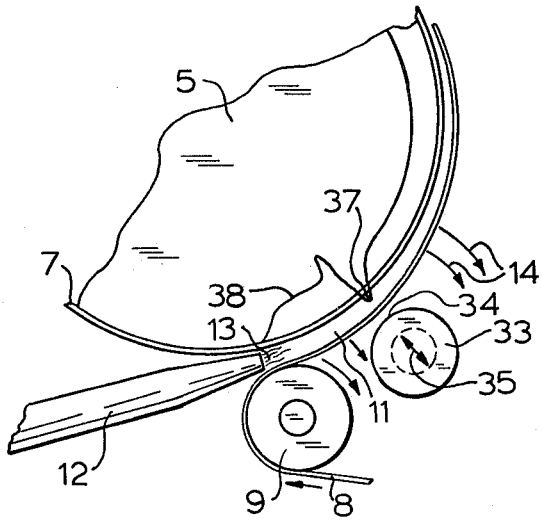
FIG. 3 is a schematic illustration of a roll former embodying another modification of the invention.

Referring to FIG. 3, another modified pulsing device 33 comprises a bar which may be cylindrical or semicylindrical and with its curved perimeter located transversely relative to the belt 8 and of a length substantially the same as the width of the belt and spaced a proper distance from the outer face of the belt to attain optimum results with respect to the characteristics of the paper making slurry being processed into paper web. Tubular or cylindrical bar stock suitable for the purpose provides excellent strength for long spans. Mounting of the pulsing device 33 is preferably such as to permit appropriate adjustment in the spacing between the pulsing surface 34 of the device and the belt 8, as indicated by doubleheaded directional arrow 35. Whereas the device 33 will result in a fiber distribution pulse 37 of fairly uniform width in the drainage curve 38, height of the pulse can be readily adjusted to suit particular requirements by adjusting distance of the device 33 relative to the belt 8.

From the foregoing, it will be apparent that the present invention attain substantial improvement in formation of paper produced on roll formers. Instead of the normally uniform pressure developed between twin forming belts or wires wrapping a forming roll, superimposed pressure variations or pulses, in effect, create shear in the fiber suspension to enhance formation. By selection of the shape and number of the pulsing devices and the control parameters, optimum pulsing results can be assured. By way of example, a number of deflectors or pulsing devices have been shown each of which will produce a different shape and length of pressure pulse in the drainage area of the forming zone.

It will be understood that variations and modifications may be effected without departing from the spirit and scope of the novel concepts of this invention.

We claim as our invention:

1. A method of attaining uniformity in forming a paper web on a roll former, comprising:

directing a jet of paper making fiber stock slurry into a primary drainage area of a forming zone defined between convergently related cotravelling inner and outer forming belts, wherein said inner belt wraps the perimeter of a rotary forming roll throughout a substantial circumferential area and provides a form retaining backing for said inner belt throughout the extent of said primary drainage area, at least said outer belt being porous for drainage therethrough and beyond the primary drainage area also wrapping said forming roll with the paper web squeezed between the belts;

effecting primary drainage in said primary drainage area;

and locating a narrow pulse generating surface at an adjustable stationary position along said primary drainage area in adjacently spaced relation to, and across the width of, said outer belt and thereby momentarily interrupting freedom of drainage through said outer belt from the travelling paper stock slurry, but permitting free drainage from said drainage area through said outer belt both upstream and downstream from said surface, and thus generating and imposing a pressure pulse on mobile fibers in suspension in said stock slurry as the stock travels through said pulse in said primary drainage area, resulting in substantially uniform distribution of said fibers before the fibers become locked in the paper web.

2. A method according to claim 1, which comprises mounting a pulsing bar device providing said generating surface across the width of said outer forming belt and adjacently spaced from the outer face of said outer belt.

3. A method according to claim 2, which comprises adjusting the spacing between said bar device surface and said outer forming belt in relation to the character of the paper making fiber stock slurry.

4. A method according to claim 3, which comprises also adjusting the position of said bar device longitudinally of the direction of travel of the forming belts.

5. A method according to claim 1, which comprises mounting a drainage deflector bar having said pulsing surface flat and facing toward said outer forming belt.

6. A method according to claim 1, which comprises providing said pulse generating and imposing surface curved in the direction of travel of said belts.

7. In a roll former paper web making apparatus:

convergently related cotravelling inner and outer forming belts defining therebetween a forming zone having a primary drainage area, said inner belt wrapping the perimeter of a rotary forming roll throughout a substantial circumferential area and said roll providing a form retaining backing for said inner belt throughout the extent of said primary drainage area, at least the outer of said belts being porous for drainage therethrough, and beyond said primary drainage area also wrapping said forming roll with the paper web squeezed between the belts;

means for directing a jet of paper making fiber stock slurry into said primary drainage area for primary drainage at least through said outer belt;

and a narrow pulse generating surface located at an adjustable stationary position along said primary drainage area and in adjacently spaced relation to, and across the width of, said outer belt for momentarily interrupting freedom of drainage through said outer belt from the travelling paper stock slurry, but permitting free drainage from said drainage area through said outer belt both upstream and downstream from said surface, and thereby generating and imposing a pressure pulse on mobile fibers in suspension in said stock slurry as the stock travels through said pulse in said drainage area, whereby substantially uniform distribution of said fibers is effected before the fibers become locked in the paper web.

8. Apparatus according to claim 7, wherein said pulse generating surface is on a pulsing bar device mounted to extend across the width of said outer forming belt.

9. Apparatus according to claim 8, including means for mounting said pulsing bar device for adjustment of the spacing between said outer forming belt and said pulse generating surface in relation to the character of the paper making fiber stock slurry.

10. Apparatus according to claim 9, wherein said bar device is adjustable for also adjusting the position of said pulsing surface longitudinally relative to the direction of travel of the forming belts.

11. Apparatus according to claim 7, wherein said pulse generating surface is flat and located on a drainage deflector bar and located in adjacent spaced relation to said outer forming belt.

12. Apparatus according to claim 7, wherein said pulse generating surface is on a deflector bar located in spaced adjacent relation to the outer face of said outer forming belt, said surface curved in the direction of travel of said belts.

13. Apparatus according to claim 12, including means for mounting said bar for adjusting the spaced relation between the surface and said outer forming belt.

14. Apparatus according to claim 13, wherein said bar is adapted for adjustment in the direction of travel of said belts.

* * * * *